US008113139B2

(12) United States Patent
Kim et al.

(10) Patent No.: US 8,113,139 B2
(45) Date of Patent: Feb. 14, 2012

(54) GAS WIPING APPARATUS HAVING ADJUSTABLE GAS GUIDE

(75) Inventors: Gun Young Kim, Pohang (KR); Hae Doo Park, Pohang (KR); Dong Eun Lee, Pohang (KR); Won Cheol Chung, Pohang (KR)

(73) Assignee: Posco, Pohang (KR)

( * ) Notice: Subject to any disclaimer, the term of this patent is extended or adjusted under 35 U.S.C. 154(b) by 264 days.

(21) Appl. No.: 12/517,565

(22) PCT Filed: Dec. 12, 2006

(86) PCT No.: PCT/KR2006/005400

§ 371 (c)(1),
(2), (4) Date: Jun. 4, 2009

(87) PCT Pub. No.: WO2008/069362

PCT Pub. Date: Jun. 12, 2008

(65) Prior Publication Data

US 2010/0031879 A1 Feb. 11, 2010

(30) Foreign Application Priority Data

Dec. 8, 2006 (KR) ..... 10-2006-0124771

(51) Int. Cl.
*B05C 11/00* (2006.01)
*B05C 13/02* (2006.01)
*B05D 3/04* (2006.01)

(52) U.S. Cl. ..... 118/63; 118/62; 427/349

(58) Field of Classification Search ..... 118/62, 118/63

See application file for complete search history.

(56) References Cited

U.S. PATENT DOCUMENTS

| | | | | | |
|---|---|---|---|---|---|
| 3,607,366 | A * | 9/1971 | Kurokawa | 427/349 |
| 3,917,888 | A * | 11/1975 | Beam et al. | 427/433 |
| 4,041,895 | A * | 8/1977 | Overton et al. | 118/704 |
| 4,346,129 | A * | 8/1982 | Decker et al. | 427/348 |
| 5,074,242 | A * | 12/1991 | Bricmont | 118/665 |
| 5,221,345 | A * | 6/1993 | Blankenship et al. | 118/63 |
| 2009/0114149 | A1 * | 5/2009 | Lee et al. | 118/62 |
| 2009/0159233 | A1 * | 6/2009 | Takeda et al. | 164/461 |

FOREIGN PATENT DOCUMENTS

| | | | |
|---|---|---|---|
| JP | 53095831 | A | 8/1978 |
| JP | 58048656 | A | 3/1983 |
| JP | 187152 | U | 6/1989 |
| JP | 1230758 | A | 9/1989 |
| JP | 2205663 | A | 8/1990 |

(Continued)

*Primary Examiner* — Dah-Wei Yuan
*Assistant Examiner* — Karl Kurple
(74) *Attorney, Agent, or Firm* — The Webb Law Firm

(57) ABSTRACT

A gas wiping apparatus is a type of equipment for coating a molten metal onto a steel strip, in which the molten metal solution deposited on the steel strip is wiped to adjust a coating thickness. The gas wiping apparatus includes a body containing a high pressure gas and a multiple nozzle unit disposed at the body to eject the high pressure gas onto a surface of a moving coated steel strip. The surface of the coated steel strip passing through a hot dipping bath filled with the molten metal is wiped by a high speed gas jet. Here, the molten metal is prevented from splashing even at a high-speed and the steel strip can be adjusted in the coating thickness stably and uniformly.

14 Claims, 13 Drawing Sheets

FOREIGN PATENT DOCUMENTS

| | | | | |
|---|---|---|---|---|
| JP | 4074857 | A | | 3/1992 |
| JP | 9241813 | A | | 9/1997 |
| JP | 410204599 | A | * | 8/1998 |
| JP | 2006328487 | A | | 12/2006 |
| KR | 0158572 | B1 | | 8/1998 |
| KR | 20040110831 | A | | 12/2004 |
| KR | 10-2006-0050419 | | * | 6/2006 |

* cited by examiner

[Fig. 1]
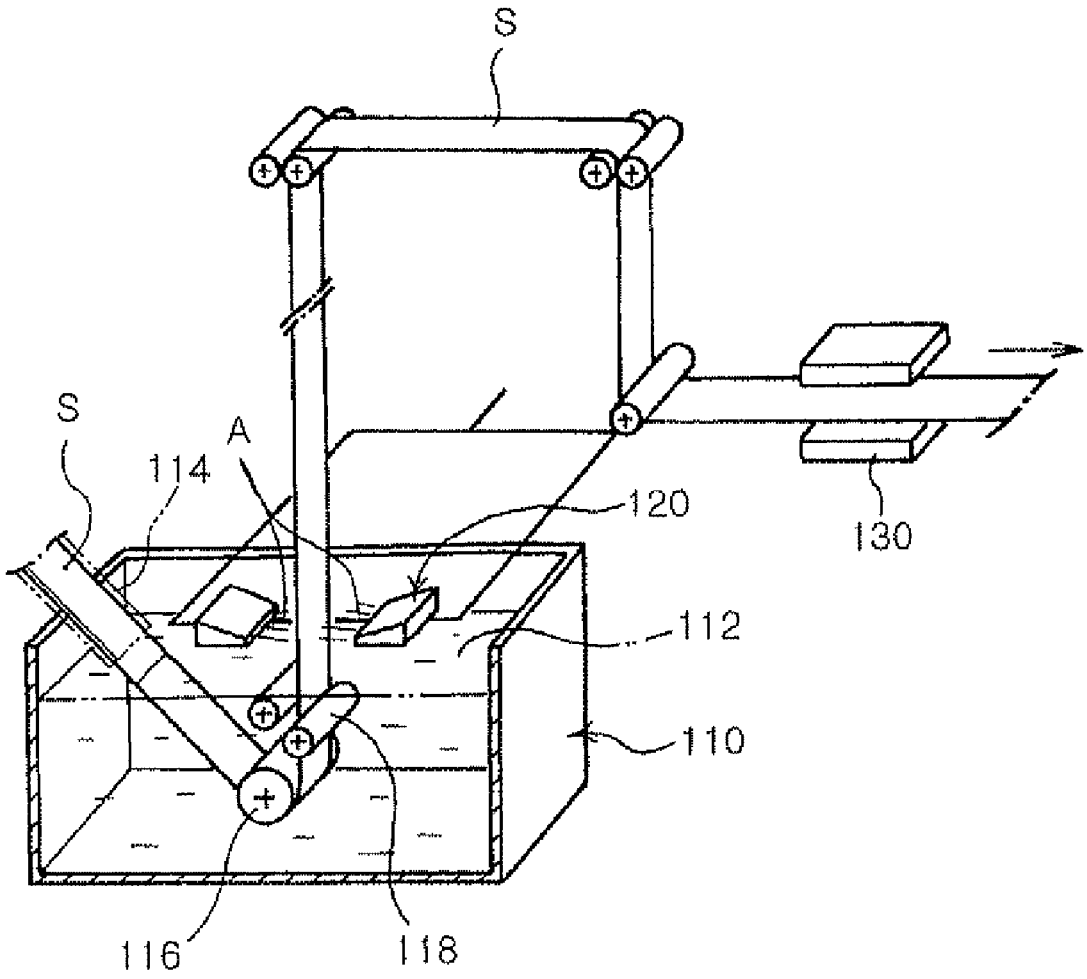
PRIOR ART

[Fig. 2]
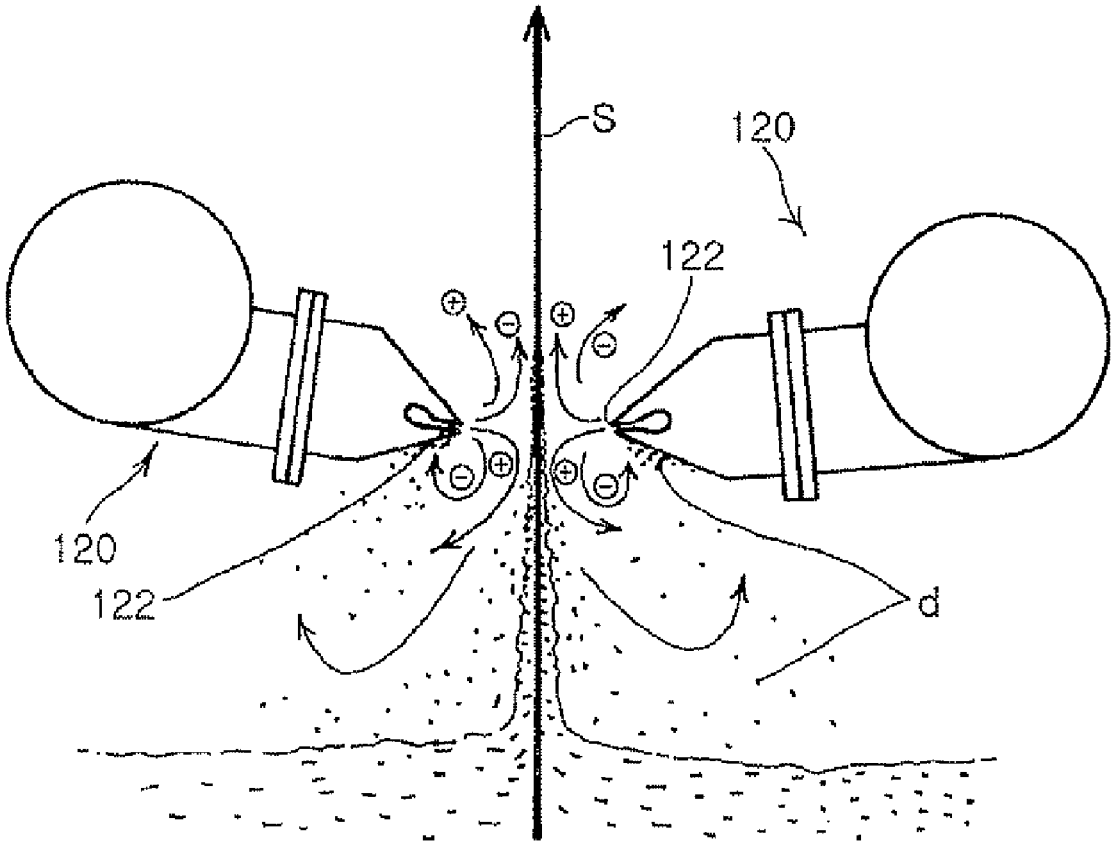
PRIOR ART

[Fig. 3]
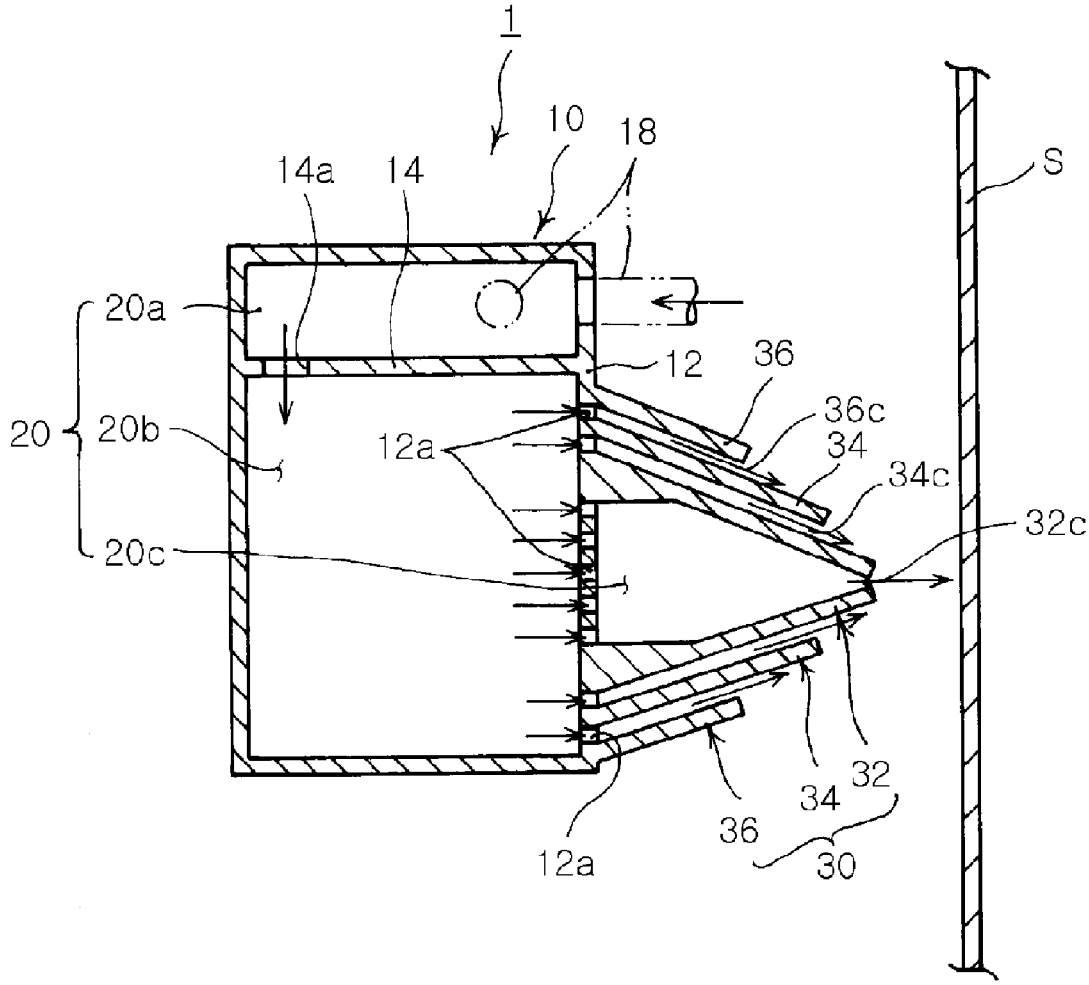

[Fig. 4]
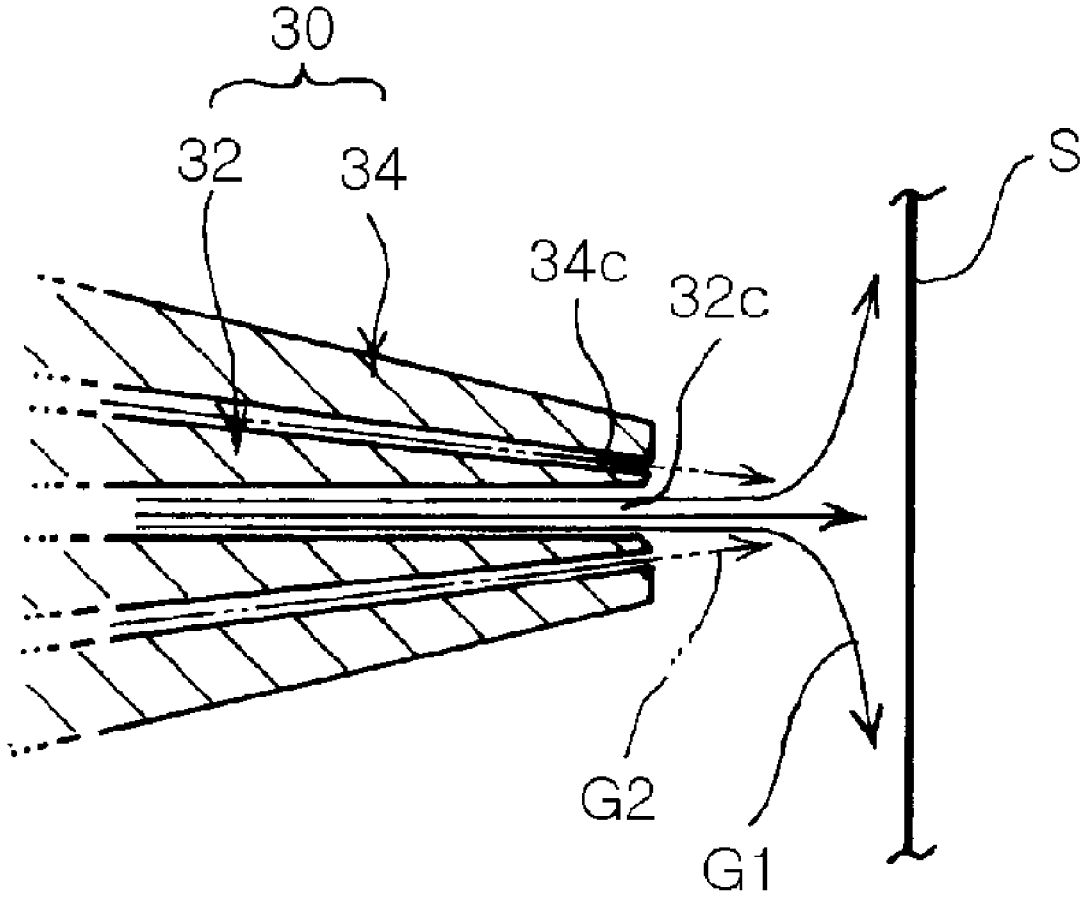

[Fig. 5]
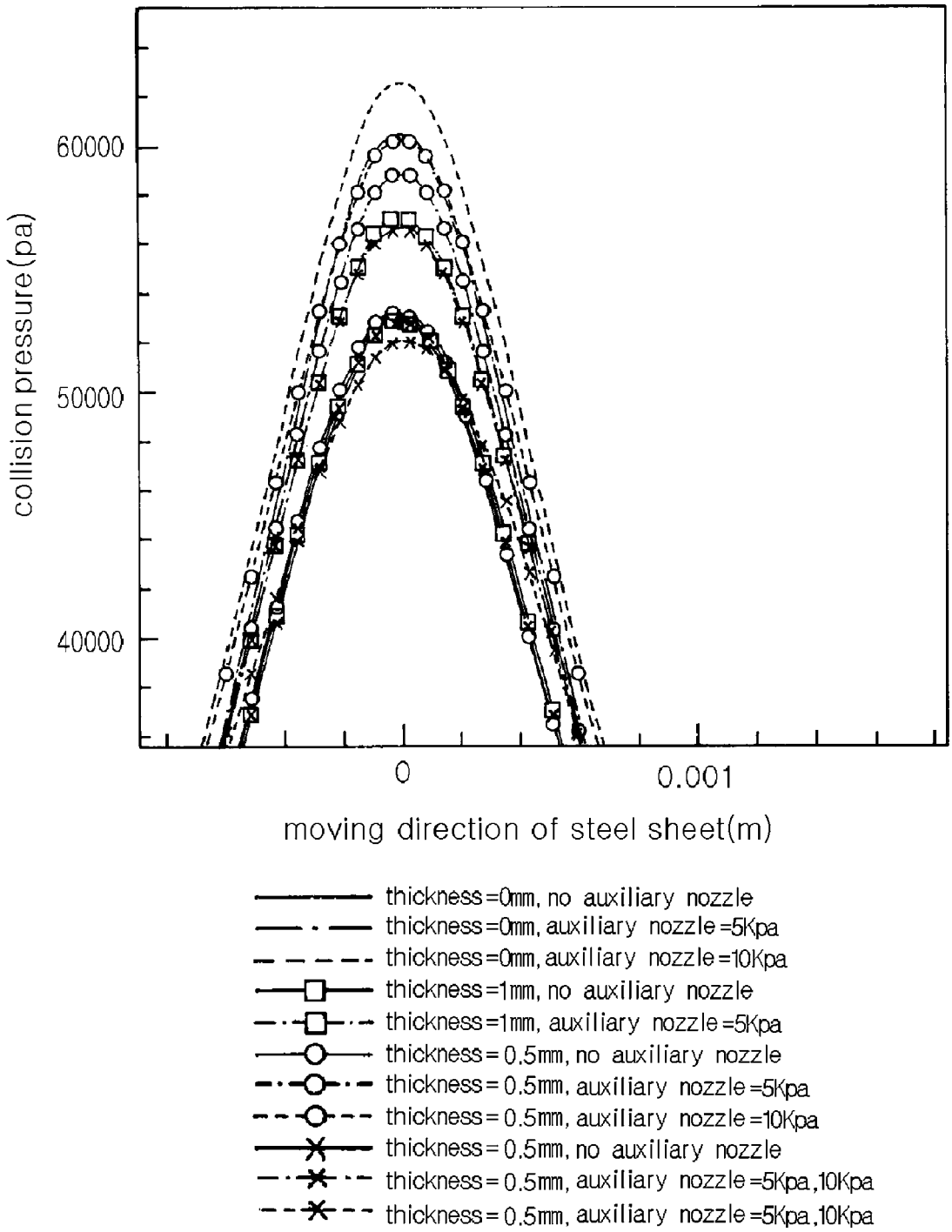

[Fig. 6]
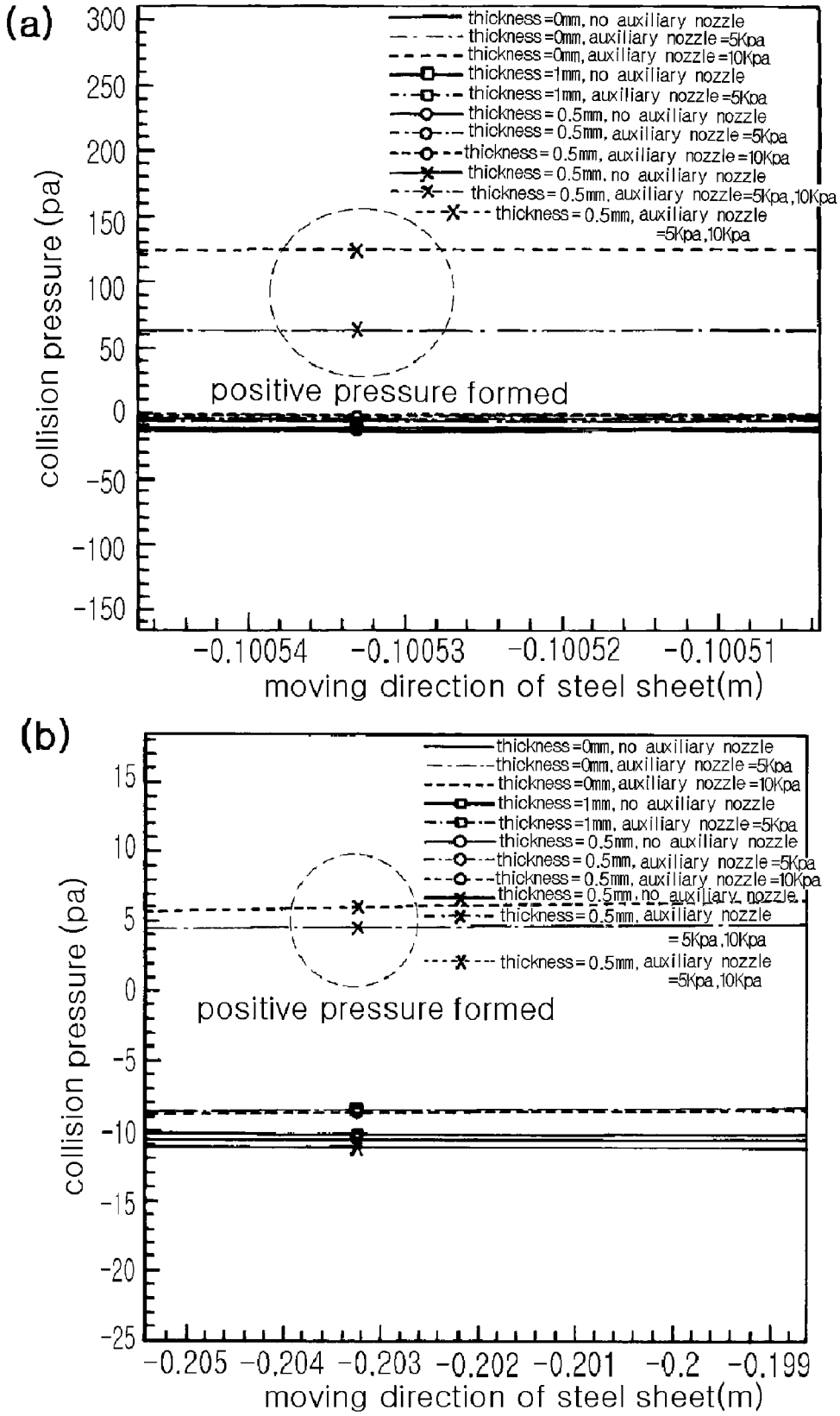

[Fig. 7]
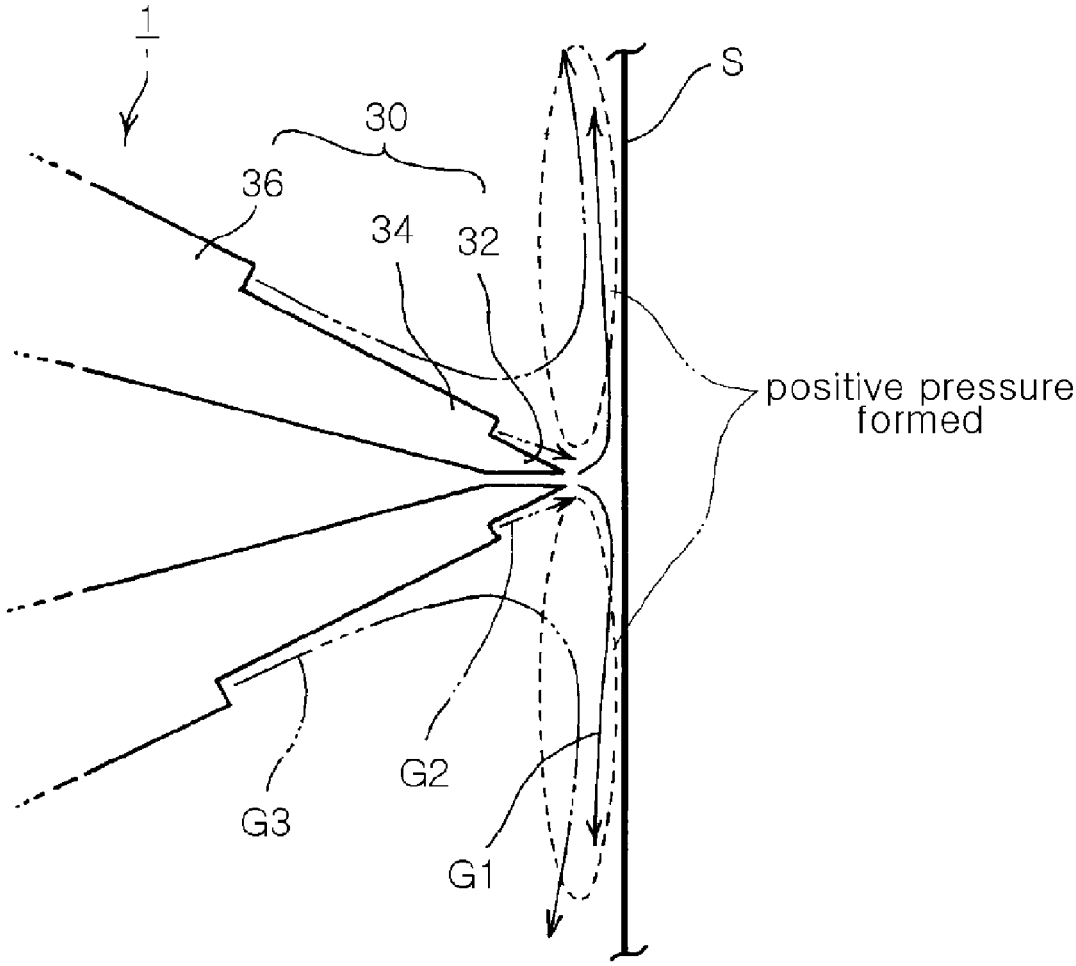

[Fig. 8]
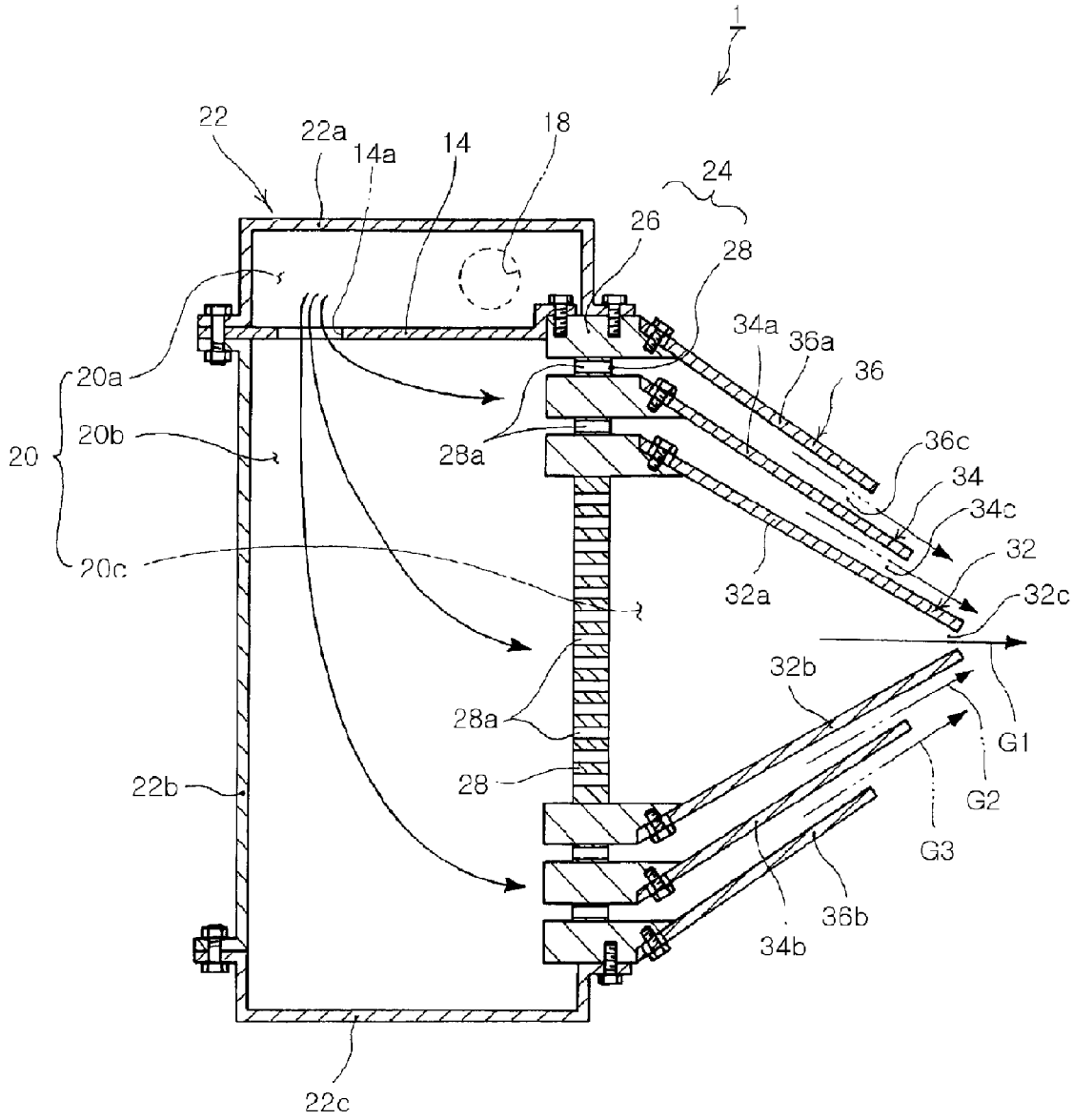

[Fig. 9]
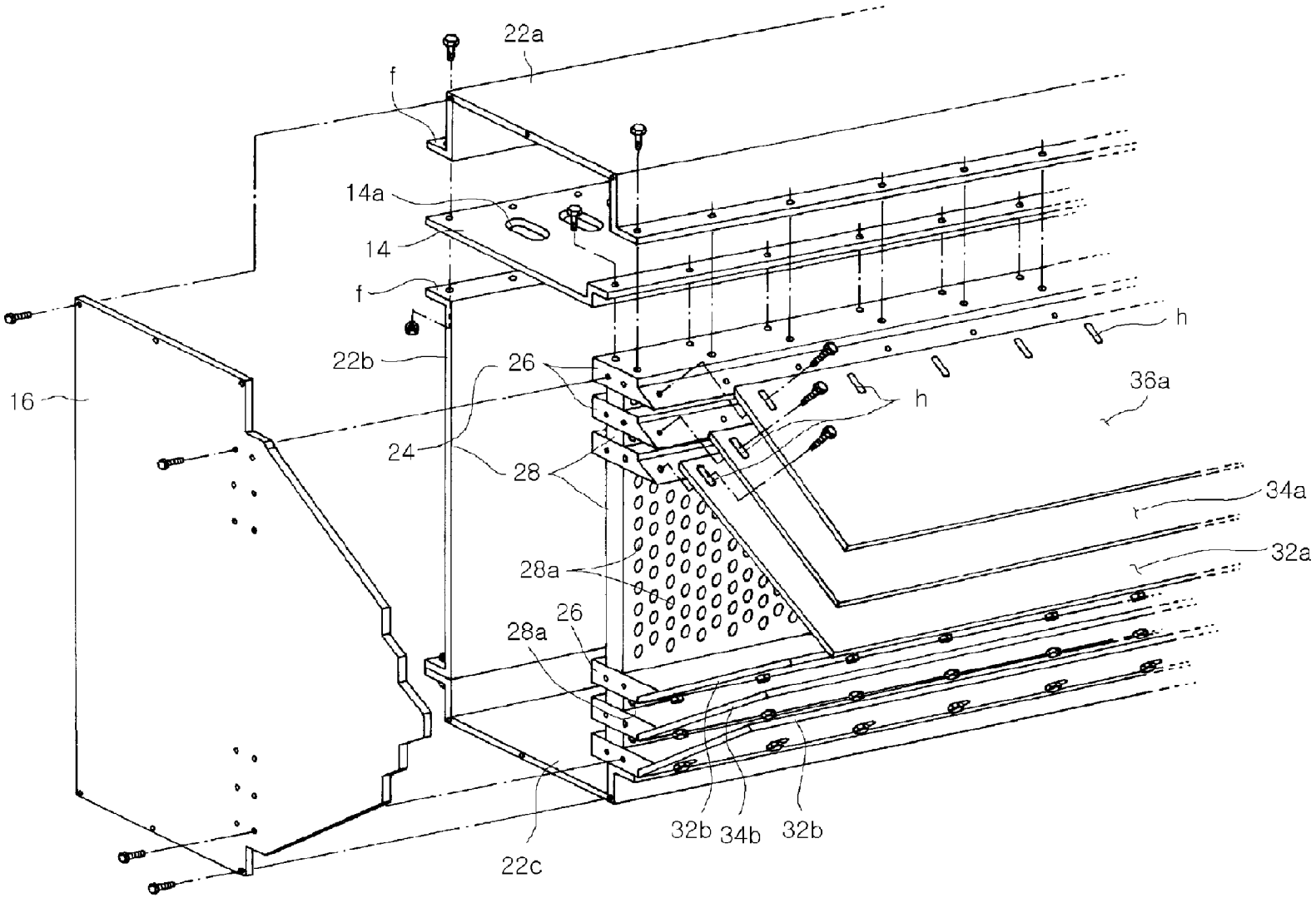

[Fig. 10]
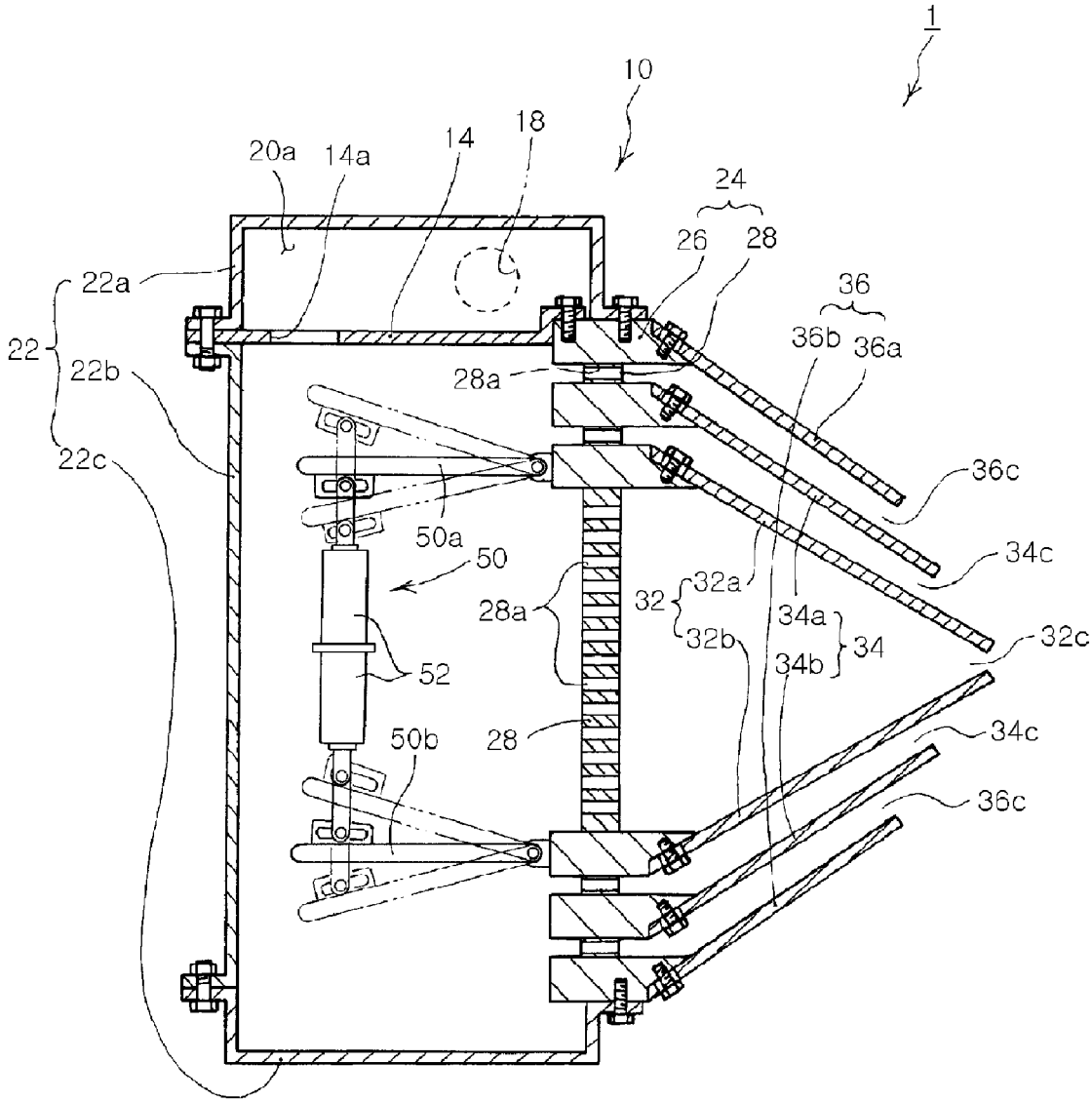

[Fig. 11]
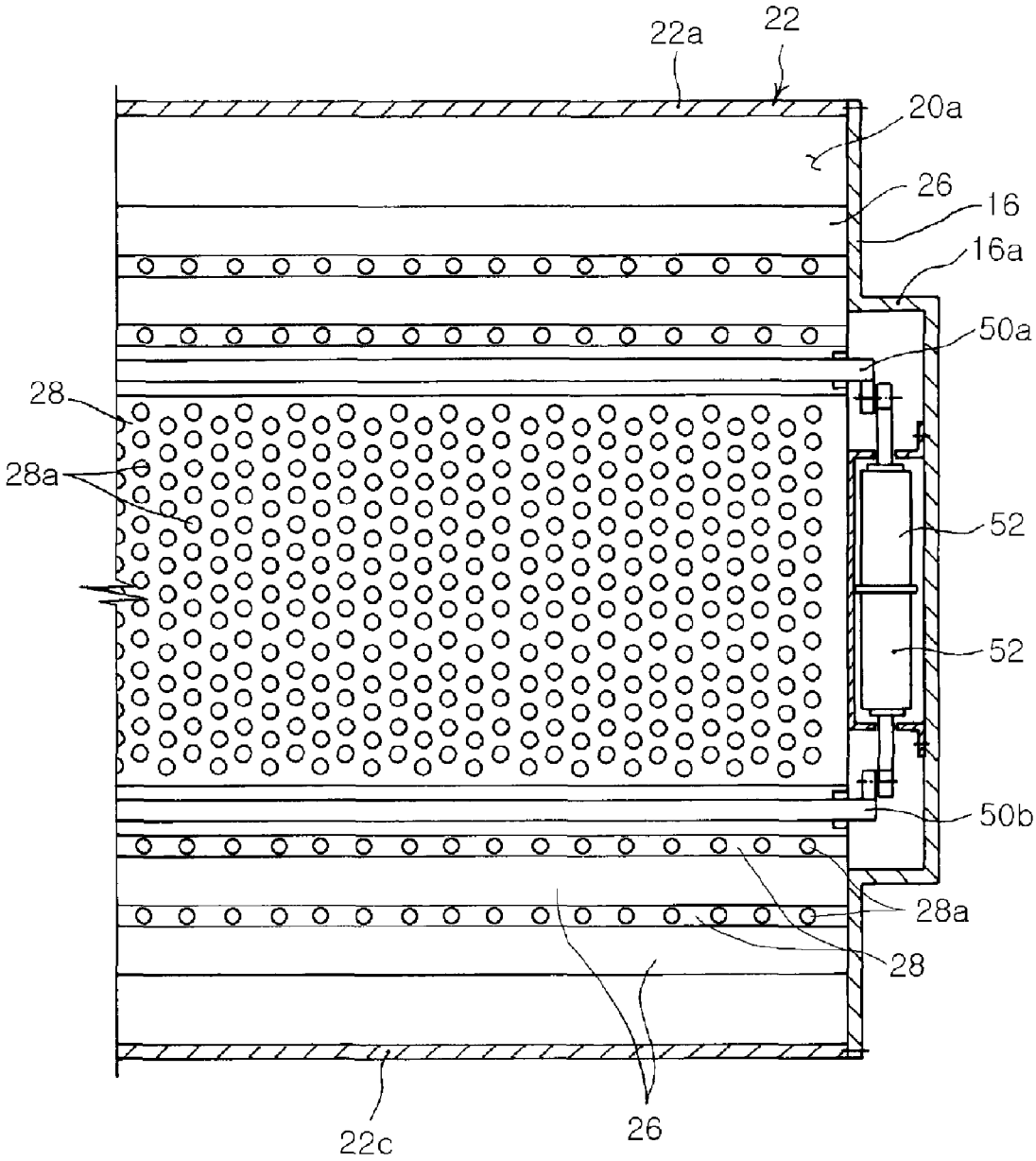

[Fig. 12]
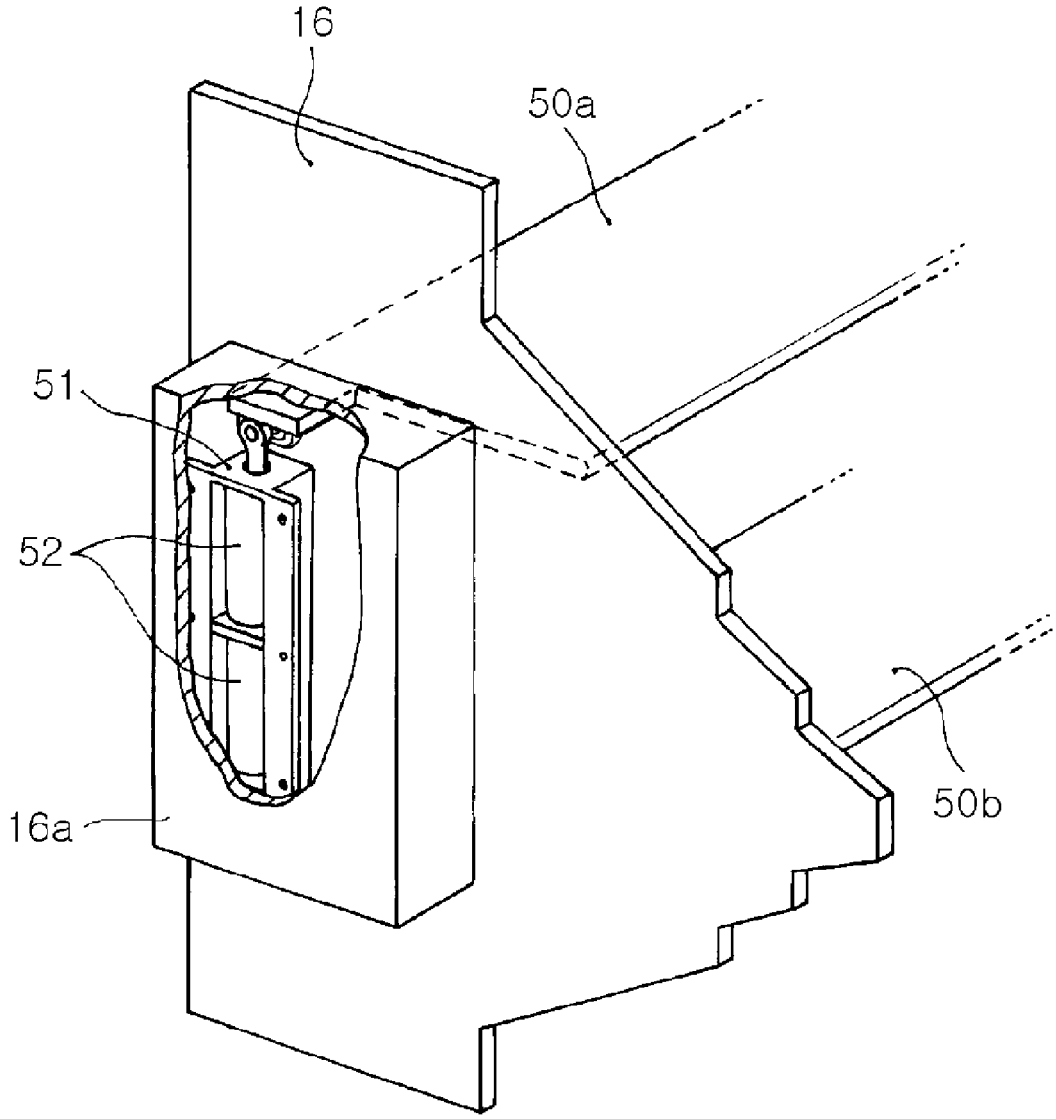

[Fig. 13]
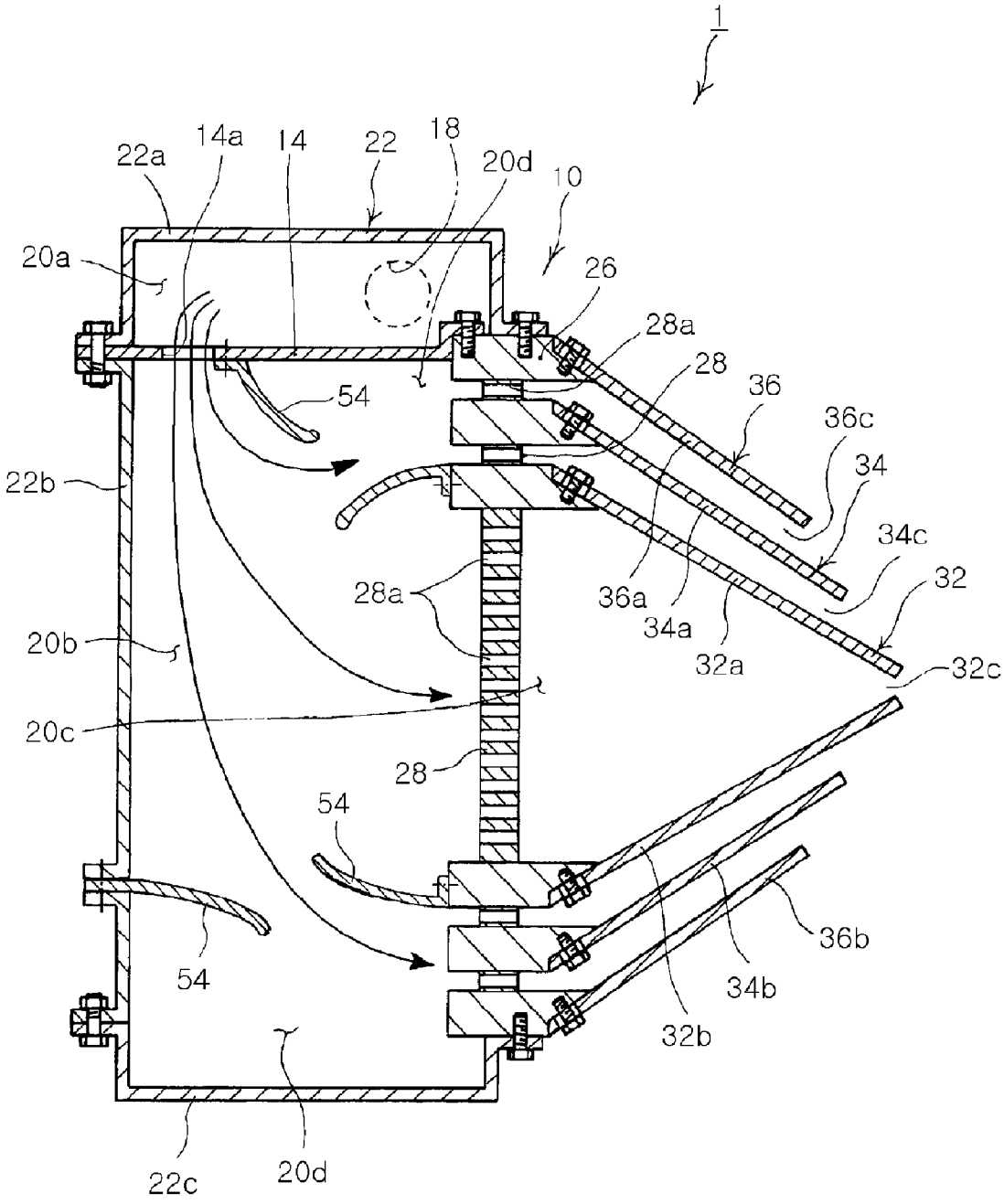

GAS WIPING APPARATUS HAVING ADJUSTABLE GAS GUIDE

TECHNICAL FIELD

The present invention relates to a gas wiping apparatus for coating a molten metal such as molten zinc on the surface of a steel strip, in which the molten metal solution deposited on the steel strip is wiped to adjust a coating thickness of the steel strip. More particularly, the present invention relates to a multi-nozzle gas wiping apparatus which can wipe the surface of the coated steel strip passing through a hot dipping bath filled with a molten metal by a high speed gas jet to restrain the molten metal from splashing even at a high-speed and adjust a coating thickness (coating thickness) of the coated steel strip stably and uniformly.

BACKGROUND ART

A steel strip, especially a coated steel strip obtained by coating a specific molten metal, e.g., molten zinc onto a cold-rolled steel strip, is highly corrosion-resistant and has aesthetic appearance.

Especially, lately, this coated steel strip has been utilized in electronic products or automobiles, thus calling for development of a manufacturing method for a higher-quality coated steel strip.

The steel strip is chiefly coated by virtue of continuous hot dip galvanizing.

For example, as shown in FIG. 1, a coil steel strip (cold-rolled steel strip) S uncoiled from a pay off reel is thermally treated in a furnace through a welder and an entry looper. Then the coil steel strip S passes through a hot dipping bath 110 filled with molten zinc 112 through a snout 114 to be coated.

Next, the steel sheet passes through a gas wiping apparatus 120 (or an air knife) disposed over a molten level of the hot dipping bath. In this case, the molten metal solution (zinc) of the steel strip S is adequately worn from surfaces thereof by a high-pressure air or a non-active gas such as nitrogen, which will be hereinafter referred to as 'gas', blown onto the steel strip. This allows the steel strip to be adjusted in its coating thickness as shown in A of FIG. 1.

Afterwards, a gauge 130 measures whether the steel strip is coated to an appropriate coating thickness. The measured value is fed back to adjust a gas ejection pressure of the gas wiping apparatus 120 and an interval between the steel strip S and the gas wiping apparatus 120, thereby continuously controlling a coating amount of the steel strip.

Here, reference signs 116 and 118 in FIG. 1, which are not described, indicate a sink roll for guiding the steel strip into the hot dipping bath and a stabilizing roll for suppressing vibration of the steel strip.

As described above, the gas wiping apparatus (air knife) 120 is the important equipment for determining a coating thickness of the steel strip to meet consumer's demand.

FIG. 2 illustrates splashing of a molten metal solution (molten zinc) which occurs in a gas wiping apparatus 120.

As shown in FIG. 2, a high-speed high-pressure gas is ejected through outlets 122 e.g., slits formed between upper and lower lips of the gas wiping apparatus 120, to collide against surfaces of the steel strip. Here, molten metal particles, e.g., molten zinc particles, (which will be hereinafter referred to as zinc chips) deposited on the steel strip are splashed due to gas moving upward and downward at a high speed.

For example, in FIG. 2, the gas ejected from the gas outlets at a high pressure and a high speed causes a negative pressure area to be formed around the outlets owing to the gas traveling fast so that the zinc chips d are splashed from the surfaces of the coated steel strip.

Meanwhile, currently, to boost production of the coated steel strip, the steel strip is made to move at a higher speed. Also, to lower costs of the steel strip, a molten metal layer is required to be coated on the steel strip to a thickness as small as possible within a desired extent.

In the case of thin coating, greater portions of the molten metal should be worn from the surfaces of the coated steel strip passing through the hot dipping bath as indicated with reference numeral 110 of FIG. 1. Therefore, this requires gas to move at a higher speed, thereby increasing a collision pressure.

However, as described above, the higher speed of the gas ejected proportionally aggravates splashing of the zinc chips so that the gas is limitedly increased in its ejection speed.

The zinc chips d splashed as described above are deposited on or around the outlets of the gas wiping apparatus, causing the gas to be ejected with non-uniform distribution along a width direction of the steel strip. This results in defective coating of the steel strip.

Therefore, to restrain the molten metal from splashing during thin coating, currently the steel strip moves at a lower speed to be coated, thus limiting a high-speed travel of the steel strip and eventually degrading production of the steel strip.

Lately, a major concern with the gas wiping apparatus 120 is to eject the gas at a high speed and a high pressure while moving the steel strip faster and maximally suppressing the zinc chips from splashing which adversely affects product quality.

Conventionally, several technologies with regards to the gas wiping apparatus have been proposed to suppress the zinc chips from splashing. However, these technologies entail a complicated separate structure other than the gas wiping apparatus. Also, with the technologies, the zinc chips are not effectively prevented from splashing in an actual coating process.

SUMMARY OF THE INVENTION

The present invention has been made to solve the foregoing problems of the prior art and therefore an aspect of the present invention is to provide a multi-nozzle gas wiping apparatus, which can wipe the surface of a steel strip passing through a hot dipping bath filled with molten metal by a high speed gas jet while suppressing zinc chips from being scattered even during a high-speed coating.

Another aspect of the invention is to provide a multi-nozzle gas wiping apparatus, in which multiple uniform pressure spaces (chambers) are formed to ensure a gas jet to be sprayed uniformly through the multiple nozzle unit along a width direction of a steel strip, and also turbulent components of the gas jet are inhibited to allow the jet to be sprayed stably.

Technical Solution

According to an aspect of the invention, the gas wiping apparatus includes a body containing a high pressure gas; and a multiple nozzle unit disposed at the body to eject the high pressure gas onto a surface of a moving coated steel strip.

Preferably, the body is configured as a chamber defining a space for containing the high pressure gas supplied through a gas feed pipe which is connected to the body, and gas exhaust holes are perforated in a side wall of the chamber, where the multiple nozzle unit is installed, to spray the high pressure gas therethrough.

More preferably, the body has a partition wall for dividing the space for containing the high pressure gas into first and second uniform pressure spaces, wherein the partition wall has gas passage holes perforated therein.

The multiple nozzle unit includes a main nozzle disposed at the side wall of the chamber of the body to communicate with the gas exhaust holes in the chamber; and at least one auxiliary nozzle disposed over and under the main nozzle, respectively, to communicate with the gas exhaust holes.

Preferably, the main nozzle includes one nozzle, and the auxiliary nozzle includes first and second auxiliary nozzles disposed over and under the main nozzle, respectively.

Also, the gas wiping apparatus further includes a third uniform pressure space formed inside the main nozzle, communicating with the second uniform pressure space of the chamber through the gas exhaust holes.

The main nozzle and the auxiliary nozzle include upper and lower lips joined to the side wall of the chamber, the upper and lower lips defining main and auxiliary gas outlets.

The main and auxiliary gas outlets are disposed at a predetermined interval sequentially from the chamber, in a moving direction of the steel strip.

The chamber of the body includes a chamber body containing the high pressure gas therein; and a lip support unit disposed at the chamber body and provided therein with the lips of the multiple nozzle unit.

The lip support unit includes lip supports having the upper and lower lips of the main and the auxiliary nozzles slantingly and movably engaged therewith; and a support body having gas exhaust orifices for exhausting the high pressure gas contained in the chamber toward the gas exhaust outlets formed between the lips, the support body integrally connected to the lip supports to support the wiping device against load.

The gas wiping apparatus further includes a first gas guide disposed in the uniform pressure spaces of the chamber and configured to adjust an amount of the high-pressure gas flowing to the main and auxiliary nozzles.

The first gas guide includes guide plates which are rotatably connected to a corresponding one of the lip supports for supporting the main nozzle in the lip support unit, the guide plates installed rotatably in the chamber by a driving unit vertically associated therewith.

The driving unit is disposed on the side wall of the chamber not to interfere with a flow of the high-pressure gas and comprises a driving cylinder having the guide plates connected thereto.

The gas wiping apparatus further includes a second gas guide disposed in the uniform pressure spaces of the chamber and configured to allow the high-pressure gas to flow to the main nozzle and the auxiliary nozzle at a uniform amount.

The second gas guide comprises the guide plates which define a gas passage opening in the second uniform pressure space while forming a fourth uniform pressure space therebetween.

Advantageous Effects

In a multi-nozzle gas wiping apparatus according to the invention, the surface of a steel strip passing through a hot dipping bath filled with a molten metal is wiped by a high speed gas jet. Meanwhile, zinc chips are effectively prevented from splashing even during a high speed coating, thereby increasing productivity of the coating process.

Moreover, multiple uniform pressure spaces (chambers) are formed inside the gas wiping apparatus to ensure a gas jet to be sprayed uniformly through the multiple nozzle unit along a width direction of the steel sheet. Also, turbulent components of the jet are inhibited to ensure the jet to be sprayed stably.

Therefore, the gas wiping apparatus having the multiple nozzle unit prevents zinc chips from splashing by adjusting a coating thickness of the steel sheet. This also allows the gas to be ejected uniformly along a width direction of the steel sheet, ultimately enhancing coating quality of the steel strip.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view illustrating an example of a conventional continuous hot dip galvanizing apparatus;

FIG. 2 is a view illustrating splashing of zinc chips in a conventional gas wiping apparatus (air knife);

FIG. 3 is a schematic configuration view illustrating a multi-nozzle gas wiping apparatus according to the invention;

FIG. 4 is a view illustrating a gas wiping by the multi-nozzle gas wiping apparatus according to the invention;

FIG. 5 is a graph illustrating collision pressures of wiping gases on a steel strip in a conventional single nozzle apparatus and a multiple nozzle apparatus of the invention, respectively;

FIGS. 6(*a*) and (*b*) are graphs illustrating negative pressures generated around a corresponding nozzle in the conventional single nozzle apparatus and a multiple nozzle apparatus of the invention, respectively, in which FIG. 6(*a*) is a graph illustrating negative pressures generated at levels 10 cm up and down from the nozzle; and (FIG. 6(*b*) is a graph illustrating negative pressures generated at levels 20 cm up and down from the nozzle;

FIG. 7 is a view illustrating operation of a three-nozzle gas wiping apparatus according to the invention;

FIG. 8 is a configuration view illustrating a multi-nozzle gas wiping apparatus according to a preferred embodiment of the invention;

FIG. 9 is an exploded perspective view of FIG. 8;

FIG. 10 is a configuration view illustrating a multi-nozzle gas wiping apparatus according to another embodiment of the invention;

FIG. 11 is a partial rear view of FIG. 10;

FIG. 12 is a partially broken perspective view of FIG. 10; and

FIG. 13 is a structural view illustrating a multi-nozzle gas wiping apparatus according to further another embodiment of the invention.

BEST MODE FOR CARRYING OUT THE INVENTION

The present invention will now be described in detail.

A gas wiping apparatus (or an air knife) adjusts a coating thickness of a steel strip. In the gas wiping apparatus, a high-pressure gas (air or inactive gas) is blown at a high speed through a nozzle thereof to collide against a steel strip, thereby generating a collision pressure.

Here, the higher pressure of the gas sprayed causes gas particles to move more dynamically, thereby wiping a coating layer of the steel strip to a small thickness.

Also, as the steel strip travels faster, more gas should participate in wiping per unit time so that the gas should be ejected at a higher pressure or at a higher speed.

For example, when it comes to a gas wiping for adjusting a coating thickness of the steel strip, the coating thickness is varied according to a moving speed of the steel strip, a pressure and speed of the gas sprayed from the nozzle and a gap between the steel strip and the nozzle.

However, in a case where the steel strip needs to be coated thinly, the steel strip can move faster by spraying the gas from the nozzle at a higher pressure and accordingly increasing a collision pressure of the gas with respect to the steel strip.

Here, high-speed gas particles collide against the steel strip and are redirected to move along a length direction of the steel strip at a high speed. The gas flowing along a length direction of the steel strip generates shear stress on surfaces of a molten metal deposited on the steel strip. The gas will be hereinafter referred to as a 'wall jet'.

Therefore, when such shear stress surpasses surface tension of a molten coating layer of the steel strip, particles of the molten coated layer fall off, causing metal chips or zinc chips to be splashed as shown in FIG. 2.

Meanwhile, in the conventional gas wiping apparatus using a single nozzle shown in FIG. 2, for example, the zinc chips are splashed, when the steel strip travels at a speed of 160 mpm and is coated to a coating thickness up to 40 g/m$^2$.

Therefore, when the steel strip moves at a speed of at least 160 mpm, in the conventional gas wiping apparatus (air knife), the steel strip is hardly coated to a coating thickness of up to 40 g/m$^2$.

That is, with a rapidly rising demand for the coated steel strip for use in, e.g., automobiles or electric products, high-speed coating or thin coating has faced a limitation.

Therefore, the gas wiping apparatus of this invention ensures the steel strip to be coated to a small thickness even at a high speed.

Exemplary embodiments of the present invention will now be described in detail with reference to the accompanying drawings.

First, FIG. 3 illustrates basic configuration of a multi-nozzle gas wiping apparatus 1.

As shown in FIG. 3, the gas wiping apparatus 1 having the multiple nozzle unit includes a body 10 for containing a high-pressure gas (air or inactive gas) and a multiple nozzle unit 30 installed at the body to eject the high-pressure gas onto a moving, coated steel strip.

Here, the body 10 is configured as a chamber defining a space 20 for containing the high-pressure gas therein. Such a chamber is joined to a frame which fixes the apparatus to both sides of the moving steel strip.

Also, gas exhaust holes 12*a* are perforated in a side wall 12 of the chamber, where the multiple nozzle unit 30 is installed, to spray the high pressure gas therethrough.

Moreover, the body 10 has a horizontal partition wall 14 for dividing the space 20 into first and second uniform pressure spaces 20*a* and 20*b*. The partition wall 14 has gas passage holes perforated therein.

Preferably, as will be explained in detail below, the body 10 further includes a third uniform pressure space 20*c* formed inside a main nozzle 32, communicating with the second uniform pressure space 20*b* of the chamber through the gas exhaust holes 12*a*.

Therefore, referring to FIG. 3, the gas is provided at a high pressure through a high pressure feed pipe 18 which is connected to a side wall (16 of FIG. 9) of the chamber 10 or to an upper part thereof. When the gas is fed through the high pressure feed pipe 18 connected, the gas is fed to the second uniform pressure space 20*b* from the first uniform pressure space 20*a* through the gas passage holes 14*a*. Subsequently, the gas is exhausted to the third uniform pressure space 20*c* disposed inside the main nozzle 32 through the gas exhaust holes 12*a* perforated in the side wall of the chamber.

In this fashion, the high-pressure gas is distributed uniformly to each of the uniform pressure spaces and then sprayed through the main nozzle 32 and first and second auxiliary nozzles 34 and 36 of the multiple nozzle unit 30.

That is, the high-pressure gas is ejected uniformly along a width direction of the steel strip through the main nozzle 32 and the first and second auxiliary nozzles 34 and 36, thus allowing the steel strip to be coated with a uniform thickness.

As shown in FIG. 3, the multiple nozzle unit 30 is disposed at the side wall of the chamber to communicate with the gas exhaust holes 12*a* perforated in the side wall 12 of the chamber 10. Also, the multiple nozzle unit 30 includes the main nozzle 32 for adjusting a coating thickness of the steel strip and the first and second auxiliary nozzles 34 and 36 disposed over and under the main nozzle 32 to connect to the gas exhaust holes. Here, the auxiliary nozzles 34 and 36 serve to prevent the molten metal from splashing.

That is, according to characteristics of the invention, the gas wiping apparatus 1 includes the main nozzle 32 and at least one auxiliary nozzle, preferably, the first and second auxiliary nozzles 34 and 36 sequentially disposed over and under the main nozzle 32.

Reference signs 32*c*, 34*c* and 36*c* in FIG. 3, which are not described, denote gas exhaust outlets of the nozzles.

FIG. 4 illustrates gas colliding against a steel strip when sprayed through a multiple nozzle unit 30 including a main nozzle 32 and at least one auxiliary nozzle (first auxiliary nozzle) 34.

That is, as shown in FIG. 4, a main gas G1 sprayed from the main nozzle 32 collides against surfaces of the steel strip S to adjust a coating thickness thereof. A gas G2 sprayed from the first auxiliary nozzle 34 surrounds the main gas G1, thereby preventing zinc chips (metal chips) from splashing as described with reference to FIG. 2.

For example, the gas sprayed from the main nozzle may have greater shear stress along a length direction of the steel strip than surface tension of a coating layer. However, in this case, the gas ejected from the first auxiliary nozzle surrounds the main gas from the main nozzle, thereby preventing zinc chips from splashing caused by the gas ejected from the main nozzle.

Then, FIG. 5 illustrates a collision pressure of gas with respect to a steel strip in a case where a conventional single nozzle is employed, and main and auxiliary nozzles are adopted together, respectively.

That is, as shown in FIG. 5, in a case where the auxiliary nozzle is employed, the collision pressure of the gas with respect to the steel strip in a moving direction of the steel strip is higher than in a case where only the single nozzle (indicated with 'no auxiliary nozzle') is employed.

That is, according to the invention, the gas ejected from the main nozzle and the gas ejected from the auxiliary nozzle cooperatively increase a collision pressure of the entire gas with respect to the steel strip. At the same time, the gas ejected from the auxiliary nozzle prevents zinc chips from splashing.

Therefore, when a coating amount is adjusted with the gas ejected at an identical speed in the conventional single nozzle and the main and auxiliary nozzles, respectively, the collision pressure of the sprayed gas with respect to the steel strip is increased in the gas wiping apparatus 1 of the invention, assuring the steel strip to be coated thinly while suppressing zinc chips from splashing.

FIGS. 6*a* and 6*b* illustrate negative pressures generated at levels 10 cm and 20 cm from the center of the nozzle with respect to a moving direction of a steel strip.

That is, as shown in FIG. 6*b*, in a case where the main nozzle 32 and the auxiliary nozzles 34 are employed, the wall jet is insufficiently decreased in its speed. This generates a negative pressure resulting from the high speed flow of gas in areas a bit away from a collision point along a length direction of the steel strip, i.e., 20 cm up and down from the center of the nozzles. This potentially causes the zinc chips to splash.

However, as shown in FIG. 6*a*, a negative pressure due to the high-speed flow of gas hardly occurs in areas less away from the collision point along a length direction of the steel strip, i.e., 10 cm up and down from the center of the nozzle.

Accordingly, as shown in FIG. 3, preferably, the second auxiliary nozzle 36 is installed together with the first auxiliary nozzle 34. This increases an ambient pressure and eliminates a negative pressure partially generated on the steel strip around the nozzles of the gas wiping apparatus (air knife), thereby forming an activated positive pressure. This prevents zinc chips from splashing on the entire molten coating layer of the steel strip.

FIG. 7 illustrates distribution of gas sprayed in a most desirable case where a main nozzle 32 and first and second auxiliary nozzles 34 and 36 are employed in a multi-nozzle gas wiping apparatus 1.

The main nozzle 32 and the first auxiliary nozzle 34 of the multiple nozzle unit 30 eject gases G1 and G2 necessary for gas wiping which meets high-speed thin coating conditions.

The second auxiliary nozzle 36 ejects a gas G3 at a relatively lower speed than the main nozzle and the first auxiliary nozzle. Thus, gas particles sprayed from the main nozzle at a high speed, collide against the steel strip, and are mixed with gas particles ejected from at least the second auxiliary nozzle (preferably first and second auxiliary nozzles) at a lower speed to decrease the overall gas speed. This accordingly allows the wall jet to move at a lower speed along a length direction of the steel strip. This weakens shear stress and thus restrains zinc chips from splashing.

FIGS. 8 to 13 illustrate detailed structures of a multi-nozzle gas wiping apparatus 1 of the invention, whose basic functions have been explained above.

First, FIGS. 8 and 9 illustrate a gas wiping apparatus 1 including a lip support unit 24 according to another embodiment of the invention of FIG. 3.

For example, the body 10 of the invention described above is configured as a chamber, and includes a space 20 for containing a high-press gas composed of first to third uniform pressure spaces 20*a*, 20*b* and 20*c*, a chamber body 22 fixed to the fixing frame and a lip support unit 24 provided to the chamber body and having a main nozzle and first and second auxiliary nozzles.

Here, the lip support unit 24 includes lip supports 26 and a support body 28. The lip supports 26 have upper and lower lips of the main, first and second nozzles 32, 34 and 36 slantingly and movably engaged therewith. The support body 28 has gas exhaust orifices 28*a* for exhausting the high-pressure gas toward gas exhaust outlets and is integrally connected to the lip supports to support the wiping device against load.

Therefore, in the gas wiping apparatus 1 according to the modified embodiment of the invention as shown in FIGS. 8 and 9, the lip support unit 24 constitutes a main body to sustain load. Accordingly, to render the chamber body 22 of the invention sufficiently strong, a thickness of the chamber body 22 engagingly fixed to the lip support unit 24 does not need to exceed that of a chamber body of a conventional gas wiping apparatus.

Here, to build the chamber body 22, flanges f with three bent pieces 22*a*, 22*b*, and 22*c* are assembled together by bolts and nuts to enable separate components to be installed therein in a case where the gas wiping apparatus undergoes maintenance and repair, or is fabricated. The upper and lower pieces 22*a* and 22*c* of the chamber are connected to the upper and lower lip supports 26 of the lip support unit, respectively.

Meanwhile, the main nozzle 32 and the first and second auxiliary nozzles 34 and 36 include the main lip 32*a* and 32*b* and the first and second upper and lower lips 34*a*, 34*b*; 36*a*, 36*b* which can be assembled and dissembled on the lip supports 26 of the lip support unit 24. These main, first and second upper and lower lips are slantingly installed on slanted surfaces of the lip supports 26.

Here, the lips have slits h perforated therein to bolt the lips therethrough on the slanted surfaces of the lip supports 26. This allows the lips to be adjustably positioned.

As a result, as shown in FIGS. 8 and 9, in the gas wiping apparatus 1 of the invention, a main outlet 32*c* is formed at a distal end of the central main lips 32*a* and 32*b*. First auxiliary outlets 34*c* are formed between the main lips and the first upper and lower auxiliary lips 34*a* and 34*b*. Likewise, second auxiliary outlets 36*c* are formed between the first auxiliary upper and lower lips 34*a* and 34*b* and the second upper and lower auxiliary lips 34*a*, 34*b*, 36*a* and 36*b*, respectively.

What is important, the main outlet 32*c* is located most adjacent to the steel strip and then the first and second auxiliary outlets 34*c* and 36*c* of the first and second auxiliary nozzles are located next to the main outlet 32*c* sequentially.

Therefore, when gases are ejected at an identical speed, the gas ejected from the main outlet exhibits a greatest collision pressure with respect to the steel strip, followed by the first and second auxiliary nozzles. When it comes to the speed of the gas sprayed onto the steel strip, the gas is most slowly ejected from the second auxiliary outlet which is located at a greatest distance.

That is, as shown in FIG. 7, the gas ejected from the main outlet and the first auxiliary outlets adjusts a coating thickness of the steel strip. Meanwhile, the gas ejected from the first and second auxiliary outlets decreases the wall jet, thereby restraining zinc chips from splashing.

Here, reference numeral 16 of FIG. 9 denotes a side wall of the body (chamber) 10.

FIGS. 10 to 12 illustrate gas wiping apparatuses 1 according to other embodiments of the invention.

As shown in FIG. 10, the gas wiping apparatus according to the modified embodiment of the invention further includes a first gas guide 50 disposed in the second uniform pressure space of the chamber and configured to adjust an amount of a high-pressure gas flowing to main and auxiliary nozzles.

The first gas guide 50 includes guide plates 50*a* and 50*b* which are rotatably connected to a corresponding one of lip supports 26 for supporting the main nozzle 32. The guide plates 50*a* and 50*b* are installed rotatably in the second uniform pressure space by a driving unit 52 or a driving cylinder vertically associated therewith.

Therefore, the guide plates 50*a* and 50*b* are pivoted about a lip support unit by the driving cylinder 52. This adjusts the amount of an internal gas flowing to the first and second auxiliary nozzles 34 and 36.

Meanwhile, the driving unit 52 or the drive cylinder, as shown in FIGS. 11 and 12, is disposed vertically in a protrusion 16*a* formed on a side wall 16 of the body (chamber) 10 and inside a cover 51 not to interfere with a flow of the high-pressure gas. Also, the driving cylinder 52 has the guide plates connected thereto.

Consequently, with the driving cylinder operated, the guide plates 50*a* and 50*b* are rotated about a hinge point of the lip support unit to adjust an amount of the gas flowing to the first and second auxiliary nozzles 34 and 36.

Here, although not designated with reference numerals in the drawings, rods of the driving cylinder are connected to the guide plates, respectively, in a structure having slits and hinge pins which can move in response to the rotation of the guide plates.

Meanwhile, in a case where the driving cylinder 52 is moved by the stroke of the rods that operate identically, the upper and lower guide plates are rotated at an identical amount. On the other hand, in a case where the driving cylinder 52 is driven separately, the upper and lower guide plates can be separately adjusted in their rotational amount.

FIG. 13 illustrates a gas wiping apparatus 1 according to further another embodiment of the invention.

The gas wiping apparatus according to this modified embodiment of the invention further includes a second gas guide 54, i.e., guide plates disposed in a second uniform pressure space of the chamber and configured to allow a high-speed gas to flow to main and auxiliary nozzles at a uniform amount.

In consequence, the second guide plates 54 define a gas passage opening in the second uniform pressure space while forming a fourth uniform pressure space 20*d* therebetween. This ensures the gas to be ejected from the main nozzle and the first and second auxiliary nozzles with uniform distribution even despite a change in the flow rate or pressure of the gas.

INDUSTRIAL APPLICABILITY

As set forth above, according exemplary embodiments of the invention, a multi-nozzle gas wiping apparatus can wipe the surface of a steel strip passing through a hot dipping bath filled with molten metal by a high-speed gas jet. Moreover, the molten metal is inhibited from splashing even during a high-speed coating, and eventually, a coating thickness (coating amount) of the steel strip can be adjusted stably and uniformly.

While the present invention has been shown and described in connection with the preferred embodiments, it will be apparent to those skilled in the art that modifications and variations can be made without departing from the spirit and scope of the invention as defined by the appended claims.

The invention claimed is:

1. A gas wiping apparatus comprising:

a body including a chamber defining a space for containing a high pressure gas;

a multiple nozzle unit disposed at the body to eject the high pressure gas onto a surface of a moving coated steel strip, wherein the multiple nozzle unit comprises a main nozzle disposed at the chamber and at least one auxiliary nozzle disposed over or under the main nozzle; and a first gas guide disposed in the chamber and configured to adjust an amount of the high-pressure as flowing to the main and auxiliary nozzles, wherein the first gas guide comprises guide plates installed in the chamber and rotatably driven by a vertically disposed driving unit therewith, wherein the driving unit is disposed on a side wall of the chamber not to interfere with a flow of the high-pressure gas and comprises a driving cylinder having the guideplat connected thereto.

2. The gas wiping apparatus according to claim 1, wherein the high pressure gas is supplied through a gas feed pipe which is connected to the body; and wherein gas exhaust holes are perforated in a side wall of the chamber, where the multiple nozzle unit is installed, to spray the high pressure gas therethrough.

3. The gas wiping apparatus according to claim 1, wherein the body has a partition wall for dividing the space for containing the high pressure gas into first and second uniform pressure spaces, wherein the partition wall has gas passage holes perforated therein.

4. The gas wiping apparatus according to claim 1, wherein the main nozzle is disposed at the side wall of the chamber to communicate with the gas exhaust holes in the chamber; and wherein the auxiliary nozzle is disposed over or under the main nozzle, respectively, to communicate with the gas exhaust holes.

5. The gas wiping apparatus according to claim 4, wherein the main nozzle comprises one nozzle, and the auxiliary nozzle comprises first and second auxiliary nozzles disposed over and under the main nozzle, respectively.

6. The gas wiping apparatus according to claim 3, further comprising a third uniform pressure space formed inside the main nozzle, communicating with the second uniform pressure space of the chamber through the gas exhaust holes.

7. The gas wiping apparatus according to claim 4, wherein the main nozzle and the auxiliary nozzle comprise upper and lower lips joined to the side wall of the chamber, the upper and lower lips defining main and auxiliary gas outlets.

8. The gas wiping apparatus according to claim 7, wherein the main and auxiliary gas outlets are sequentially disposed at predetermined intervals from the chamber, in a moving direction of the steel strip.

9. The gas wiping apparatus according to claim 7, wherein the chamber comprises:

a chamber body containing the high pressure gas therein; and a lip support unit disposed at the chamber body and provided therein with the lips of the multiple nozzle unit.

10. The gas wiping apparatus according to claim 9, wherein the lip support unit comprises:

lip supports having the upper and lower lips of the main and the auxiliary nozzles slantingly and movably engaged therewith; and a support body having gas exhaust orifices for exhausting the high pressure gas contained in the chamber toward the gas exhaust outlets formed between the lips, the support body integrally connected to the lip supports to support the wiping device against load.

11. The gas wiping apparatus according to claim 9, wherein the first gas guide is disposed in the uniform pressure spaces of the chamber.

12. The gas wiping apparatus according to claim 11, wherein the guide plates of the first gas guide are rotatably connected to a corresponding one of the lip supports for supporting the main nozzle in the lip support unit.

13. The gas wiping apparatus according to claim 3, further comprising a second gas guide disposed in the uniform pressure spaces of the chamber and configured to allow the high-pressure gas to flow to the main nozzle and the auxiliary nozzle at a uniform amount.

14. The gas wiping apparatus according to claim 13, wherein the second gas guide comprises the guide plates which define a gas passage opening in the second uniform pressure space while forming a fourth uniform pressure space therebetween.

* * * * *

UNITED STATES PATENT AND TRADEMARK OFFICE

CERTIFICATE OF CORRECTION

PATENT NO. : 8,113,139 B2
APPLICATION NO. : 12/517565
DATED : February 14, 2012
INVENTOR(S) : Gun Young Kim et al.

It is certified that error appears in the above-identified patent and that said Letters Patent is hereby corrected as shown below:

Column 9, Line 57, Claim 1, delete “as” and insert -- gas --

Column 9, Line 64, Claim 1, delete “guideplat” and insert -- guide plates --

Signed and Sealed this
Eighth Day of May, 2012

David J. Kappos

David J. Kappos
*Director of the United States Patent and Trademark Office*